US012292045B2

(12) United States Patent
Voser

(10) Patent No.: US 12,292,045 B2
(45) Date of Patent: May 6, 2025

(54) PISTON COMPRESSOR AND METHOD FOR OPERATING SAME

(71) Applicant: BURCKHARDT COMPRESSION AG, Winterthur (CH)

(72) Inventor: Alexandre Voser, Elsau (CH)

(73) Assignee: BURCKHARDT COMPRESSION AG, Winterthur (CH)

( * ) Notice: Subject to any disclaimer, the term of this patent is extended or adjusted under 35 U.S.C. 154(b) by 238 days.

(21) Appl. No.: 17/770,839

(22) PCT Filed: Oct. 21, 2020

(86) PCT No.: PCT/EP2020/079589
§ 371 (c)(1),
(2) Date: Apr. 21, 2022

(87) PCT Pub. No.: WO2021/078781
PCT Pub. Date: Apr. 29, 2021

(65) Prior Publication Data

US 2022/0372963 A1 Nov. 24, 2022

(30) Foreign Application Priority Data

Oct. 21, 2019 (EP) ..... 19204408

(51) Int. Cl.
*F04B 39/04* (2006.01)
*F04B 9/04* (2006.01)
(Continued)

(52) U.S. Cl.
CPC ..... *F04B 39/041* (2013.01); *F04B 9/045* (2013.01); *F04B 35/01* (2013.01);
(Continued)

(58) Field of Classification Search
CPC ..... F04B 39/041; F04B 9/045; F04B 35/01; F04B 39/0022; F04B 39/042;
(Continued)

(56) References Cited

U.S. PATENT DOCUMENTS 1,526,909 A 2/1925 Hiller
3,731,984 A * 5/1973 Habermann ..... F16C 32/0476 310/90.5
(Continued)

FOREIGN PATENT DOCUMENTS

CN 103994051 A 8/2014
DE 3805670 A1 9/1989
(Continued)

OTHER PUBLICATIONS

International Search report for PCT/IB2020/079589, prepared by the European Patent Office, mailing date Dec. 14, 2020, 13 pages including English Translation.
(Continued)

*Primary Examiner* — Dominick L Plakkoottam
(74) *Attorney, Agent, or Firm* — Brooks Kushman P.C.

(57) ABSTRACT

The piston compressor for compressing a gas having a cylinder and also including a piston, a piston rod, packing, a crosshead and a drive, wherein: the piston is disposed for movement in a longitudinal direction L inside the cylinder; the piston is connected to the crosshead by means of a piston rod; packing is disposed between the piston and the crosshead, through which packing the piston rod runs; the crosshead is driven by the drive; in addition an activatable magnetic bearing is disposed between the piston and the crosshead; the magnetic bearing can generate a magnetic force $F_m$ on the piston rod, at least perpendicularly to the
(Continued)

longitudinal direction L; and an activation device activates the magnetic force $F_m$ generated by the magnetic bearing on the piston rod.

14 Claims, 4 Drawing Sheets

(51) Int. Cl.

| | |
|---|---|
| ***F04B 35/01*** | (2006.01) |
| ***F04B 39/00*** | (2006.01) |
| ***F04B 39/12*** | (2006.01) |
| ***F04B 49/06*** | (2006.01) |
| ***F04B 53/08*** | (2006.01) |

(52) U.S. Cl.
CPC ..... *F04B 39/0022* (2013.01); *F04B 39/042* (2013.01); *F04B 39/122* (2013.01); *F04B 49/06* (2013.01); *F04B 53/08* (2013.01)

(58) Field of Classification Search
CPC ..... F04B 39/122; F04B 49/06; F04B 53/08; F04B 39/0005; F04B 39/121; F04B 39/12; F05B 2240/57; F05B 2240/515
See application file for complete search history.

(56) References Cited

U.S. PATENT DOCUMENTS

| | | | | |
|---|---|---|---|---|
| 4,141,604 | A * | 2/1979 | Habermann | F16C 32/0402 310/90.5 |
| 4,889,039 | A * | 12/1989 | Miller | F04B 39/045 92/162 R |
| 5,736,800 | A * | 4/1998 | Iannello | F16C 32/048 310/90 |
| 5,818,131 | A * | 10/1998 | Zhang | F04D 13/0646 310/90.5 |
| 7,815,193 | B2 | 10/2010 | Feistel et al. | |
| 9,515,589 | B2 * | 12/2016 | Kozaki | H02P 6/185 |
| 10,247,183 | B2 | 4/2019 | Koop et al. | |
| 2014/0356196 | A1 * | 12/2014 | Moore | F04B 49/103 417/266 |
| 2020/0232506 | A1 * | 7/2020 | Vikman | H02K 9/18 |

FOREIGN PATENT DOCUMENTS

| | | | |
|---|---|---|---|
| FR | 2754570 | A1 | 4/1998 |
| JP | H1267392 | A | 10/1989 |
| JP | H03160168 | A | 7/1991 |

OTHER PUBLICATIONS

Japanese Notification of Reasons for Rejection for JP Patent Application 2022-523398, prepared by the Japanese Patent Office, mailing date Jul. 2, 2024, 16 pages including an English Translation.

* cited by examiner

PISTON COMPRESSOR AND METHOD FOR OPERATING SAME

CROSS-REFERENCE TO RELATED APPLICATION

This application is the U.S. national phase of PCT Application No. PCT/EP2020/079589 filed on Oct. 21, 2020, which claims priority to EP patent application Ser. No. 19/204,408.9 filed on Oct. 21, 2019, the disclosures of which are incorporated in their entirety by reference herein.

The invention relates to a piston compressor and a method of operating the same.

STATE OF THE ART

Document WO2014/139565A1 discloses a piston compressor with a horizontally extending cylinder in which a piston is arranged that can move back and forth in the horizontal direction. This piston compressor has the disadvantage that the guide rings and/or sealing rings arranged on the piston are subject to relatively large wear, and that the piston compressor can only be operated at relatively low rotational speed. The document DE3805670A1 discloses a piston compressor with a vertically extending cylinder, wherein the piston can be designed as a labyrinth piston or as a piston provided with captured piston rings. This piston compressor also has the disadvantage that wear can occur.

DESCRIPTION OF THE INVENTION

The problem of the invention is to provide a more advantageous piston compressor, which preferably comprises a piston arranged to be movable in a horizontal direction or in a vertical direction.

This problem is solved with a piston compressor having the features of claim 1. The dependent device claims concern further advantageous embodiments. The problem is further solved with a method having the features of claim 12. The dependent method claims concern further advantageous method steps.

The problem is solved in particular with a piston compressor for compressing a gas, comprising a cylinder, a piston, a piston rod, a packing seal, a crosshead, a magnetic bearing, and a drive, wherein the piston is arranged movably in a longitudinal direction within the cylinder, wherein the piston is connected to the crosshead via the piston rod, wherein there is arranged, between the piston and the crosshead, the packing seal through which the piston rod passes, the crosshead being driven by the drive, the magnetic bearing being arranged between the piston and the crosshead, and the magnetic bearing being capable of exerting a magnetic force on the piston rod at least perpendicularly to the longitudinal direction, a sensor being arranged for detecting a state variable of the piston compressor, the magnetic bearing being designed as a controllable magnetic bearing, and a control device controlling the magnetic force exerted by the magnetic bearing on the piston rod depending on the state variable. Particularly preferred, the cylinder extends substantially in the horizontal direction.

The problem is furthermore solved in particular with a piston compressor for compressing a gas, comprising a cylinder extending substantially in a horizontal direction and comprising a piston, a piston rod, a packing seal, a crosshead and a drive, wherein the piston is arranged movably in a longitudinal direction within the cylinder, wherein the piston is connected to the crosshead via a piston rod, wherein there is arranged, between the piston and the crosshead, a packing seal through which the piston rod extends, and wherein the crosshead is driven by the drive, wherein a controllable magnetic bearing is also arranged between the piston and the crosshead, wherein the magnetic bearing can exert a magnetic force on the piston rod at least perpendicularly to the longitudinal direction, and wherein a control device controls the magnetic force exerted by the magnetic bearing on the piston rod.

The problem is furthermore solved in particular with a method for operating a piston compressor comprising a piston which is moved back and forth in a longitudinal direction within a cylinder, wherein the piston is driven via a piston rod, and wherein a magnetic force acting at least perpendicularly to the longitudinal direction is exerted on the piston rod, wherein a state variable of the piston compressor is detected, wherein the magnetic force is controlled depending on the state variable, and wherein a magnetic force, preferably a relief force, is thereby exerted via the piston rod on the piston. Particularly preferably, the longitudinal direction extends essentially in a horizontal direction.

The problem is furthermore solved in particular with a method for operating a piston compressor comprising a piston which is moved back and forth in a longitudinal direction within a cylinder, the longitudinal direction extending substantially in a horizontal direction, wherein the piston is driven via a piston rod, wherein a controllable magnetic force acting at least perpendicularly to the longitudinal direction is exerted on the piston rod and thereby a relief force is effected on the piston via the piston rod, wherein the magnetic force is controlled depending on a state variable.

The piston compressor according to the invention for compressing a gas comprises a controllable magnetic bearing which is arranged between a piston and a crosshead of the piston compressor, wherein a piston rod connects the piston to the crosshead, wherein the piston rod extends through the magnetic bearing, and wherein the magnetic bearing exerts a controllable magnetic attractive force on the piston rod at least perpendicularly to the direction of extension of the piston rod. The piston compressor according to the invention also comprises at least one sensor and a control device, wherein the control device is designed to supply electromagnets arranged in the controllable magnetic bearing with electric current or electric power, wherein the control device modulates or changes the supplied current or the supplied power depending on the value measured by the sensor in order to influence the position of the piston with respect to the cylinder, so that the piston at least temporarily has an advantageous position within the cylinder. The controllable magnetic bearing is preferably designed as a radial bearing, comprising a plurality of electromagnets arranged distributed in the circumferential direction and controllable by the control device. However, the magnetic bearing could also be designed in such a way that the magnetic force only acts in one direction or in one dimension, for example by arranging two controllable electromagnets opposite each other or symmetrically with respect to the piston rod, so that a magnetic force exerted by these electromagnets on the piston rod only acts in one dimension.

The piston compressor comprises at least one cylinder as well as a piston arranged so as to be movable back and forth within the cylinder, wherein the interior of the cylinder and thus also the movement of the piston in a preferred embodiment extends in the horizontal direction or substantially in the horizontal direction, such a piston compressor also being referred to as a horizontal piston compressor. The magnetic bearing exerts a controllable magnetic attraction force on the piston rod at least perpendicular to the direction of extension of the piston rod, and thus preferably exerts a vertically upwardly directed force on the piston rod, preferably in a direction opposite to the force of gravity.

In a preferred embodiment, the piston, which is movable in the horizontal direction, comprises a so-called guide ring, which rests on the inner surface of the cylinder. The attractive force exerted by the magnetic bearing on the piston rod at least in the vertical direction and/or the repulsive force exerted on the piston rod has the effect that the contact force of a piston supported on the inner surface of the cylinder is reduced, or that the piston or the guide ring no longer contacts the inner surface of the cylinder, so that the piston or the guide ring of the piston either rests only with reduced contact force on the inner surface of the cylinder, and particularly preferred moves back and forth within the cylinder without contacting the inner surface of the cylinder. If a piston has a guide ring, the use of the magnetic bearing results in the advantage that the contact force of the guide ring on the inner surface and thus the wear of the guide ring is reduced, so that the guide ring has a longer service life or a longer life cycle until it has to be replaced. In addition, there is the advantage that the piston compressor can, if desired, be operated at a higher rotational speed, wherein preferably no increased wear or heating occurs.

Particularly preferred, the piston of the piston compressor according to the invention is designed as a labyrinth piston, such a labyrinth piston having, as is known per se, a labyrinth structure on its surface which serves to seal between the piston and the inner surface of the cylinder. The attraction force exerted by the magnetic bearing on the piston rod is preferably controlled in such a way that the piston moving back and forth does not touch the inner surface of the cylinder along the entire stroke path. However, the piston compressor according to the invention is also suitable for pistons with piston rings and, if necessary, additionally comprising guide rings.

In a further, preferred embodiment, the interior of the cylinder and thus also the movement of the piston extends in a vertical direction or essentially in a vertical direction. The magnetic bearing exerts a controllable magnetic attraction force on the piston rod at least perpendicular to the direction of extension of the piston rod, and thus exerts a force on the piston rod and the piston extending radially or substantially radially to the piston rod. The attraction force exerted by the magnetic bearing on the piston rod at least in the radial direction and/or the repulsion force exerted on the piston rod has the effect of reducing the contact force of a piston ring bearing against the inner surface of the cylinder, and in particular a one-sided contact force, or that the piston or its piston ring, and in particular a piston designed as a labyrinth piston, no longer contacts the inner surface of the cylinder, so that the piston or the piston ring either rests only with reduced contact force on the inner surface of the cylinder, and particularly preferred the labyrinth piston moves back and forth within the cylinder without contacting the inner surface of the cylinder. The use of the magnetic bearing results in the advantage that wear of the piston ring is reduced, so that the piston compressor has a longer service life or a longer life cycle until it requires maintenance. There is also the option of operating the piston compressor at a higher rotational speed. If the piston compressor comprises a labyrinth piston, the use of the magnetic bearing has the advantage that contact between the labyrinth piston and the inner surface of the cylinder can be avoided even better, since any optional eccentric arrangement of the labyrinth piston relative to the interior of the cylinder can be at least partially corrected with the aid of the magnetic bearing, so that no mutual contact occurs. The use of the magnetic bearing results in the additional advantage that the piston compressor can be operated safely even with a reduced gap width between the outer surface of the labyrinth piston and the inner surface of the cylinder, without any occurrence of mutual contact. This reduced gap width increases the efficiency of the piston compressor or reduces the loss during compression.

In a further preferred embodiment, the piston compressor comprises at least one piston and one cylinder, and preferably a plurality of pistons and cylinders, which are preferably arranged on a common frame, and which are preferably driven by a common crankshaft. In a preferred embodiment, such a piston compressor is arranged on a ship, wherein under calm sea conditions the cylinder, the interior of the cylinder and thus also the movement of the piston are in a vertical direction or substantially in a vertical direction. A turbulent or stormy sea results in the ship performing an increasing rolling or pitching motion as the wave height increases, with the result that the entire piston compressor and thus in particular also the longitudinal direction of the piston rod has an extension which depending on the wave action is variable as a function of time and deviates from the vertical by an angle beta. In a preferred embodiment, the angle Beta, and preferably the angle Beta as a function of time, is measured as an additional state variable.

On a ship, a multistage piston compressor is used, for example, to compress exhaust gas accumulating in a liquefied gas container to a pressure of 200 to 500 bar, in order to use the compressed gas to supply a gas engine or a diesel engine of the ship with fuel. A piston compressor arranged on a ship is preferably operated in such a way that the force exerted by the magnetic bearing at least in the radial direction on the piston rod is controlled as a function of the state variable and the additional state variable in such a way that the contact force of a piston ring bearing against the inner surface of the cylinder, and in particular a one-sided contact force, is reduced, or that the piston or its piston ring, and in particular a piston designed as a labyrinth piston, no longer touches the inner surface of the cylinder, so that on a ship, even under wave action, it is ensured that the piston or piston rings of the piston compressor either rests only with reduced contact force against the inner surface of the cylinder, and particularly preferred the labyrinth piston or pistons move back and forth within the cylinder without touching the inner surface of the cylinder. The use of the magnetic bearing results in the advantage that wear of the piston ring is reduced even under wave action, or that contact of the labyrinth structure of the labyrinth piston with the inner surface of the cylinder is avoided, in particular also in the case of a small gap width between the outer diameter of the piston and the inner surface of the cylinder, so that a piston compressor arranged on a ship has a longer service life or a longer life cycle until it requires maintenance. The magnetic bearing is preferably controlled in such a way that the magnetic bearing exerts a damping effect on the piston rod radially to the longitudinal axis of the piston rod in order to damp a movement of the piston rod and the piston in a direction radial to the longitudinal axis, for example to reduce the maximum amplitude of occurring resonance vibrations or other transverse vibrations of the piston, for example caused by wave action.

Since the motion of the waves or the measured and thus derived additional state is a relatively slow process compared to the rotational speed of the piston compressor, and the period of a wave motion of the water is slow by a factor of 10 to 1000 compared to the period of a revolution of the piston compressor, it is possible to pre-calculate a short-term change in the additional state variable, and to let this value flow into the control of the magnetic bearing by controlling the magnetic bearing with a predictive control which predicts the movement of the piston compressor to be expected on the basis of the wave motion, for example for a point in time which can lie, for example, in the range between 1 and 50 seconds, and controls the magnetic bearing accordingly, so that when influencing or controlling the position of the piston rod or the piston, the magnetic bearing is controlled in such a way that the expected movement of the piston compressor caused by the wave action is taken into account.

The piston compressor according to the invention also has the advantage that it can be operated with a higher rotational speed or with a higher average piston speed, since the piston or the guide ring either no longer touches the inner wall of the cylinder at all or only rests against the inner wall of the cylinder with reduced contact force. Such operation with a higher number of revolutions is particularly advantageous for a piston compressor with a so-called dry-running piston, i.e. a labyrinth piston, or a piston with self-lubricating sealing rings, i.e. a piston whose piston rings or sealing rings are not oil-lubricated, which is also referred to as an unlubricated piston. The controllable magnetic bearing can be used either as a supporting bearing, by which the piston is held without contacting the inner surface of the cylinder, or it can be used as a relief bearing, by which the force exerted by the piston on the inner surface of the cylinder is reduced, in which case the piston contacts the inner wall. The controllable magnetic bearing can also perform a centering function on a substantially vertically extending piston, by which the piston is held centered, and preferably without contacting the inner surface of the cylinder.

In one embodiment, the magnetic bearing is arranged at a predetermined position in the horizontal piston compressor, whereas the position of the center of gravity of the piston changes constantly during operation due to backward and forward movement, so that the length of the lever arm formed by the piston rod between the magnetic bearing and the center of gravity of the piston changes constantly during operation. A control device provided for supplying power to the magnetic bearing is therefore preferably designed in such a way that the magnetic force exerted by the magnetic bearing on the piston rod is controllably modified depending on the position of the piston or depending on the length of the aforementioned lever arm. Preferably, at least one force acting in the vertical direction is exerted on the piston rod. Particularly preferred, the magnetic bearing is designed as a radial bearing which, perpendicular to the longitudinal direction of the piston rod, can exert a force on the piston rod which can be controlled in two dimensions, preferably a force in the vertical direction and a force in the horizontal direction. Advantageously, such a radial bearing is controlled in such a way that the piston does not touch the inner surface of the cylinder during operation in any of its possible positions, neither a lower nor an upper nor a lateral inner surface of the cylinder.

The magnetic bearing is preferably controlled depending on a measured state variable, in particular if the piston is not to touch the inner surface of the cylinder during operation, wherein the state variable comprises at least one of the following parameters: Displacement path of the piston in the cylinder, displacement path of the piston rod in the direction of extension of the piston rod, displacement path of the piston rod perpendicular to the direction of extension of the piston rod, and angle of rotation of the drive shaft. In a further preferred embodiment, the distance of the piston rod relative to the magnetic bearing, at least in the vertical direction, and in particular the gap width in the magnetic bearing between the piston rod and the magnetic bearing is suitable as a state variable.

The sensor for detecting the state variable is preferably designed to detect at least one of the following variables: angle of inclination β of the longitudinal direction relative to the vertical, angle of inclination β as a function of time, gap width between the inner surface of the cylinder and the side surface of the piston, location of a mutual point of contact between the piston and the cylinder.

A piston compressor typically comprises a packing seal with sealing rings, wherein the piston rod extends through this packing seal or its sealing rings in order to seal the interior of the cylinder from the outside. In a particularly preferred embodiment, in the packing seal there is also arranged the magnetic bearing in addition to the sealing rings. Such a modified packing seal comprising the magnetic bearing is particularly preferred designed as a replacement part. Particularly preferred, such a modified packing seal has the same dimensions as previously known packing seals without magnetic bearings, so that the packing seal comprising the magnetic bearing can be used for installation in existing piston compressors in order to retrofit them and improve their quality.

In a further, preferred embodiment, the modified packing seal also comprises cooling channels. In a modified packing seal mounted in a piston compressor, these cooling channels are connected to a cooling circuit to cool the magnetic bearing and/or the packing seal.

BRIEF DESCRIPTION OF THE DRAWINGS

The drawings used to explain the embodiments show.

In principle, the same parts are given the same reference signs in the drawings.

EMBODIMENTS FOR CARRYING OUT THE INVENTION

Figure 1:
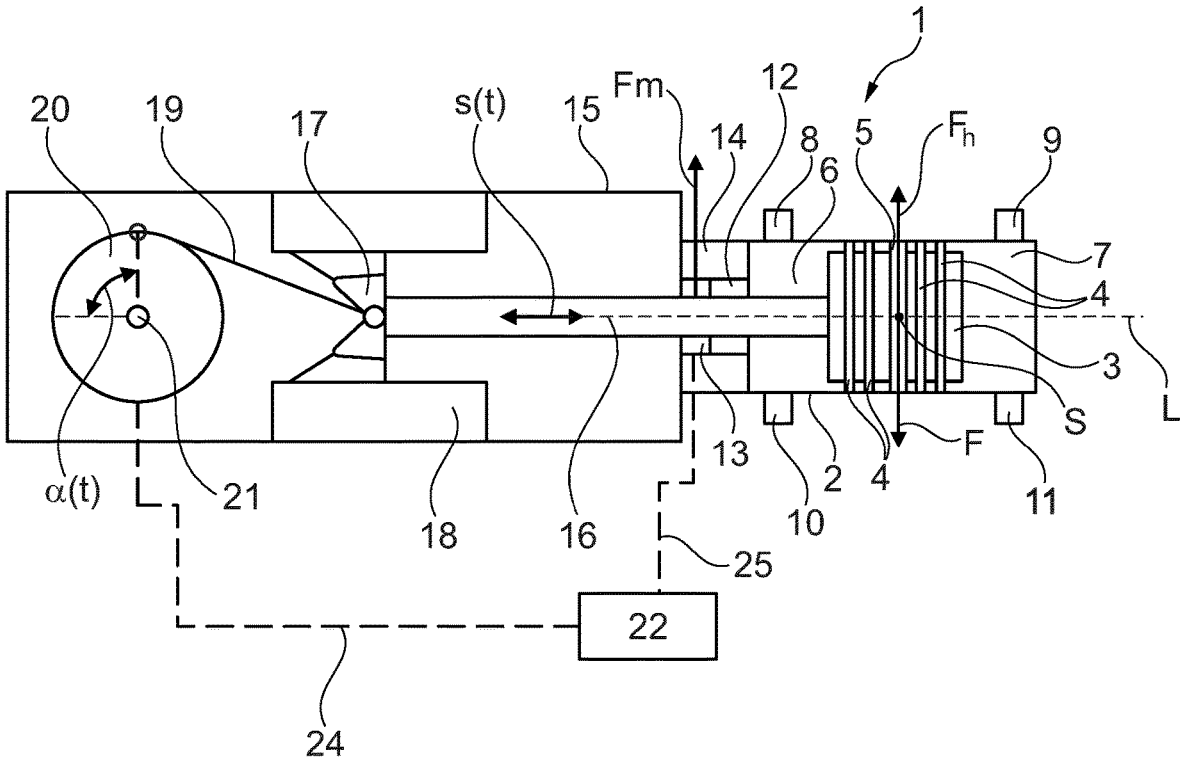
FIG. 1 a schematically simplified longitudinal section through a piston compressor.

FIG. 1 shows a piston compressor 1 for compressing a gas, comprising a cylinder 2 extending in the horizontal direction and comprising a piston 3 movable within the cylinder 2 in the direction of extension of the cylinder 2 respectively in the longitudinal direction L. The piston compressor 1 also comprises a piston rod 16, a packing seal 12, a magnetic bearing 13, a crosshead 17 with a linear guide 18, a push rod 19 and a drive, for example a crank 20 with a drive shaft 21. In the exemplary embodiment shown, the piston 3 is of double-acting design and comprises sealing or piston rings 4 as well as a guide ring 5, the piston 3 dividing the interior of the cylinder 2 into a first interior space 6 and a second interior space 7, these two interior spaces each having an inlet valve 8, 9 and an outlet valve 10, 11. The cylinder 2 is connected to a housing 15 via an intermediate piece 14, with the packing seal 12 and the magnetic bearing 13 also being arranged in the intermediate piece. The magnetic bearing 13 exerts a magnetic force $F_m$ on the piston rod 16 at least in the vertical direction. A control device 22 detects a state variable Z of the piston compressor 1 via a signal line 24 and a sensor not shown, for example the displacement path s(t) of the piston in the cylinder 7 as a function of time, the displacement path s(t) of the piston rod 16 and/or an angle of rotation α(t) of the drive shaft 21 as a function of time. The control device 22 controls, via a signal line 25, the current in the electromagnets of the magnetic bearing 13 and thereby the magnetic force exerted by the magnets on the piston rod 16.

Figure 3:
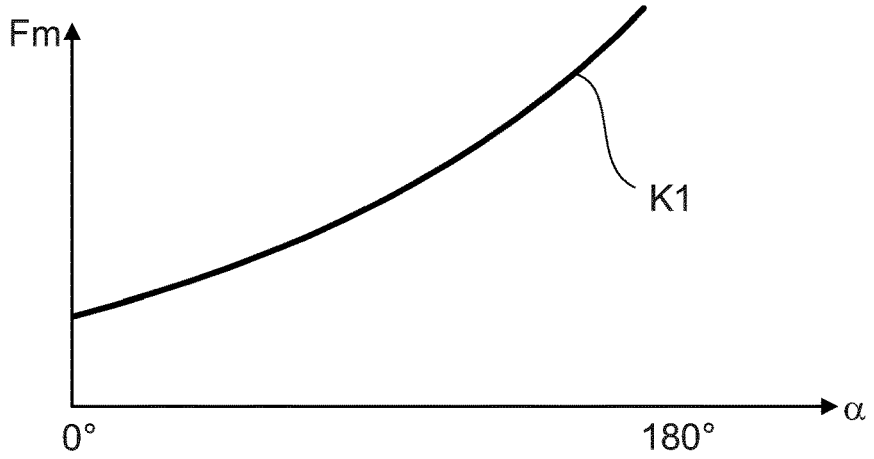
FIG. 3 an exemplary progression of the magnetic force as a function of a state variable, namely the angle of rotation of a drive shaft.

In a simple embodiment, the drive device 22 can be operated in a drive mode in which a state variable Z is measured, and the magnetic force $F_m$ is modified as a function of the state variable Z. In this case, feedback can be dispensed with. FIG. 3 shows an example of such a control mode in which the progression of a curve K1 is specified, the curve K1 specifying the relationship between the state variable Z, in the present case the angle of rotation α of the drive shaft 21, and the magnetic force $F_m$ to be generated as a function of the angle of rotation α. In the illustrated exemplary embodiment, the angle α=0° corresponds to the bottom dead center and α=180° to the top dead center of the piston 3 with respect to the second interior space 7, the magnetic force $F_m$ being smallest at the bottom dead center, because the lever arm formed by the piston rod 16 between the center of gravity S of the piston 3 and the magnetic bearing 13 is shortest, and wherein the magnetic force $F_m$ is largest at the top dead center because the lever arm formed by the piston rod 16 between the center of gravity S of the piston 3 and the magnetic bearing 13 is longest. The angle of rotation α is measured by a sensor not shown and fed to the control device 22 via the signal line 24. The curve progression K1 can be predetermined, for example, on the basis of empirical values. This embodiment is particularly preferred if, as shown in FIG. 1, a piston 3 having a guide ring 5 is used, wherein the guide ring 5 bears against the inner surface of the cylinder 2, and wherein the magnetic force F m serves to reduce the bearing force of the guide ring 5 against the inner surface of the cylinder 2, thereby in particular reducing wear of the guide ring 5. The curve K1 shown in FIG. 3 only shows the progression of the magnetic force $F_m$ as a function of the crankshaft angle α between 0° and 180°. In the subsequent section between 180° and 360°, which is not shown, the force $F_m$, starting from the value at 180°, runs in the reverse direction to the value of $F_m$ at the angle of 0°, this value being identical to the value at the angle of 360°.

Figure 2:
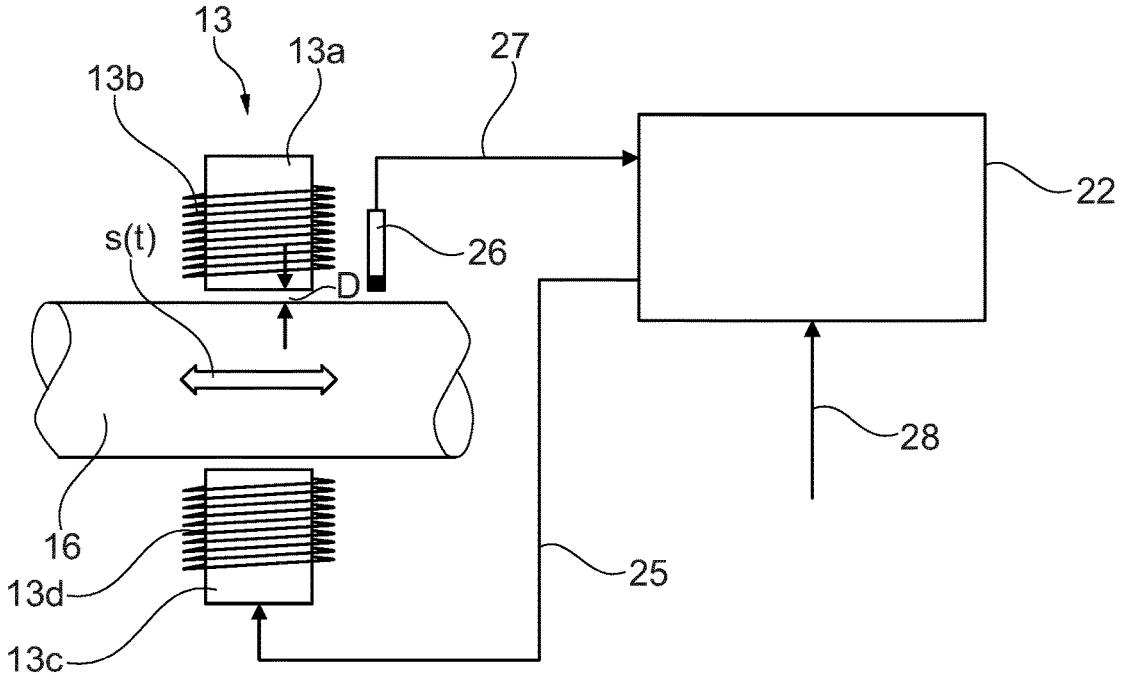
FIG. 2 a schematic illustration of a control device.
Figure 6:
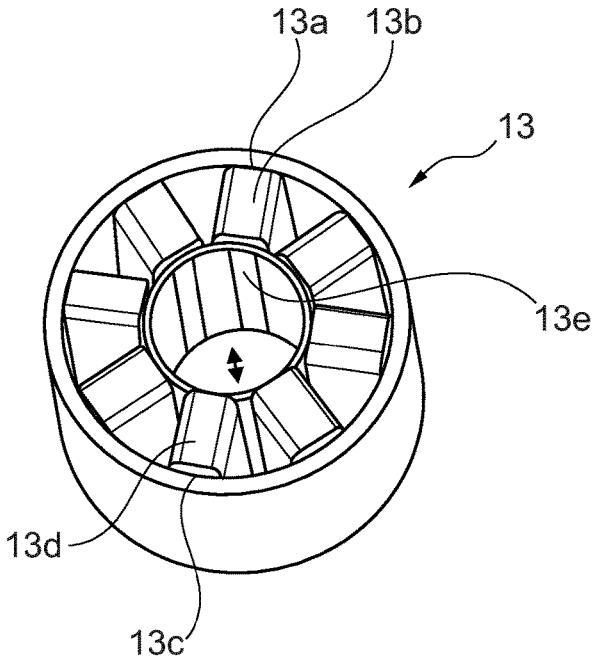
FIG. 6 a radial magnetic bearing.

In a further preferred embodiment, a measuring device, for example a sensor 26, is provided to measure the position of the piston rod 16 and/or the piston 3 at least in the vertical direction. FIG. 2 shows an embodiment which measures the position of the piston rod 16 in the vertical direction. In a preferred embodiment, the sensor 26 is arranged close to the magnetic bearing 13 or even inside the magnetic bearing 13, wherein the sensor 26 preferably measures the distance D between an upper coil core 13*a* of the magnetic bearing 13 and the surface of the piston rod 16. Preferably, the magnetic bearing 13 comprises at least an upper coil core 13*a* with coil 13*b* and a lower coil core 13*c* with coil 13*d*. As shown in FIG. 6, the magnetic bearing 13 can also be designed as a radial magnetic bearing with a plurality of electromagnets distributed in the circumferential direction, wherein their coils 13*b*, 13*d* can preferably be controlled individually so that the direction of the magnetic force $F_m$ exerted on the piston rod 16 can be determined by a corresponding control of the coils 13*b*, 13*d*.

In a preferred operating method, a setpoint for the distance D is predetermined for the control device 22 via the setpoint specification 28, with the control device 22 driving the coils 13*b*, 13*d* with current via the signal line 25 in such a way that the piston rod 16 has an essentially unaltered, constant distance D with respect to the upper coil core 13*a*, irrespective of the stroke s(t) or the crankshaft angle α(t). The piston rod 16 thereby acts as a magnetic armature of the two coil cores 13*a*, 13*b*. Preferably, the magnetic bearing 13 can exert both an upward force and a downward magnetic attraction force on the piston rod 16, so that the position of the piston rod 16 relative to the magnetic bearing 13 can be controlled particularly precisely.

The piston compressor 1 is thus preferably operated in such a way that a controllable magnetic force $F_m$ is exerted on the piston rod 16, so that a force $F_m$ acting at least in the vertical direction, or a relief force $F_h$, is exerted on the piston 3 via the piston rod 16, which counteracts the force of gravity F, the magnetic force $F_m$ being controlled or varied as a function of a state variable Z such as, for example, the distance D, the stroke s(t) or the angle of rotation α(t). The arrangement described in FIGS. 1 to 3 and the method described are also suitable for operating or controlling a piston compressor with a cylinder extending in the vertical direction and a piston moving in the vertical direction.

Figure 7:
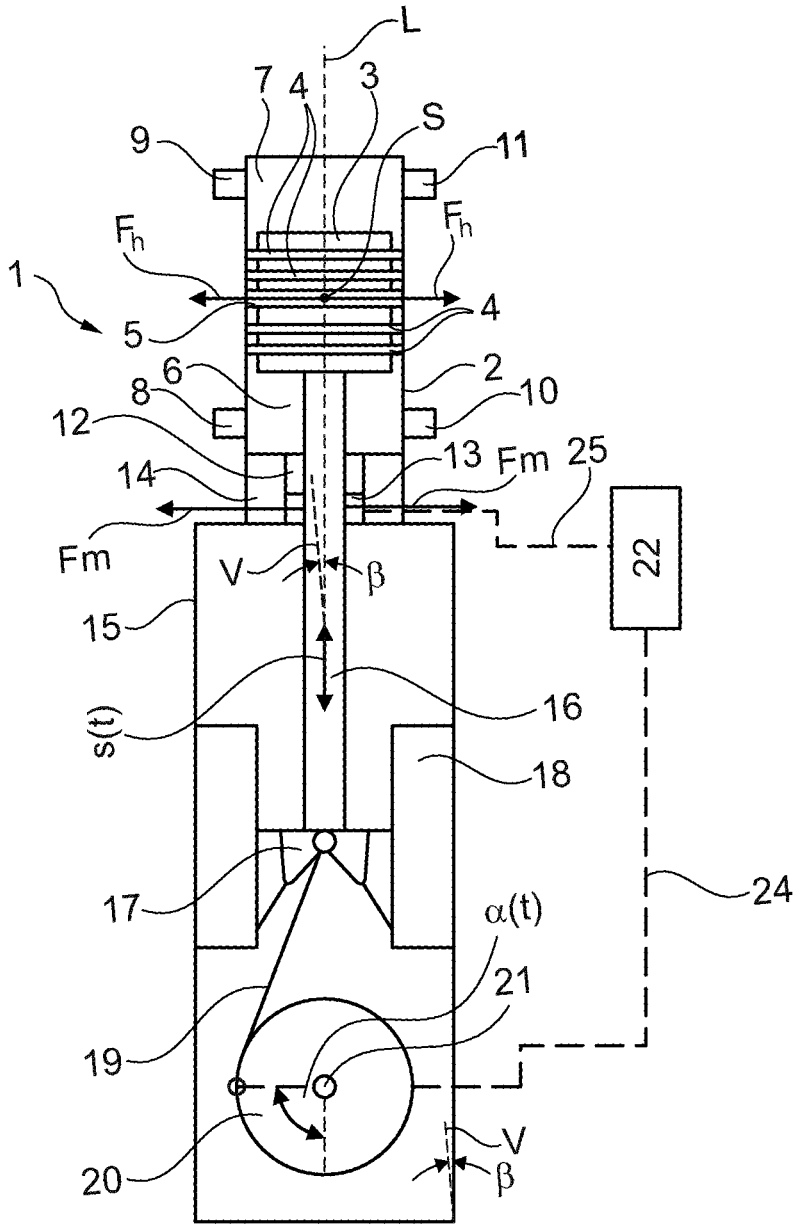
FIG. 7 an inclined piston compressor, for example on a ship with wave motion.

FIG. 7 shows the piston compressor 1 shown in FIG. 1 with a cylinder 2 or an interior of a cylinder extending essentially in the vertical direction, with a piston rod 16 extending essentially in the vertical direction, and with a piston 3 movable in this direction. In FIG. 7, the piston compressor 1 is arranged on a ship heeled with a heel angle, which is why the cylinder 2 and the piston rod 16 have an angle of inclination β with respect to the vertical V. The piston compressor 1 is preferably arranged in the ship in such a way that the cylinder 2 and the piston rod 16 are exactly in the vertical direction or at least approximately in the vertical direction when the sea is absolutely calm. The piston compressor 1 could of course also be arranged on land, and the cylinder 2 and the piston rod 16 preferably extend exactly in vertical direction or at least approximately in vertical direction. Preferably, the angle of inclination β with respect to the vertical V is measured by the sensor 26, not shown in FIG. 7, the angle of inclination β preferably being measured as a function of time t. The magnetic bearing 13 is controlled via the control device 22 in such a way that a magnetic force $F_m$ is exerted on the piston rod 16, and that the piston rod 16 transmits a relief force $F_h$ to the piston 3, so that, due to the acting relief force $F_h$, the position of the piston 3 within the cylinder 2 is influenced, if possible.

As a state variable Z for controlling the magnetic bearing 13, at least one of the following variables is suitable, in addition to or instead of the state variables Z already mentioned: Angle of inclination β of the cylinder relative to the vertical V, gap width between the inner surface of the cylinder and the side surface of the piston, location of a mutual point of contact between the piston and the cylinder.

Preferably, the magnetic bearing 13 is controlled in such a way that the mutual distance between the piston rod 16 and the magnetic bearing 13 and/or the distance between the cylinder inner surface and the piston side surface, perpendicular to the longitudinal direction L, is kept constant or substantially constant. Preferably, the piston 3 is held without wall contact in the cylinder 7. Preferably, the angle of inclination β(t) assumed between the vertical V and the longitudinal direction L is also measured as a function of time t as the state variable Z. Particularly preferred, in the case of a piston compressor arranged on a ship, the magnetic force $F_m$ is controlled by means of a predictive control. Preferably, the state variable Z comprises the inclination angle β(t) as a function of time t, such that the state variable Z is dependent on time t. In a preferred embodiment, the state variable Z comprises, in addition to the inclination angle β(t) as a function of time t, at least one further state variable mentioned herein, so that such a resulting state variable consists of a combination of at least two state variables mentioned herein. For example, a resulting state variable could comprise the state variable Z of the movement of the piston rod perpendicular to the longitudinal direction L, and be combined with the state variable Z of the inclination angle β(t) as a function of time t, so that with the aid of the predictive control and the knowledge of the state variable Z of the angle of inclination β(t) as a function of the time t, the expected movement of the piston rod perpendicular to the longitudinal direction L caused by the angle of inclination β(t) at the time t+Δt can be predicted, and the magnetic bearing 12 can be controlled with this predictive state variable Zv (t+Δt).

Preferably, a predictive state variable Zv (t+Δt) is calculated from the state variable Z(t) depending on the angle of inclination β(t) for a future point in time t+Δt, and the magnetic force $F_m$ is controlled at the current point in time t depending on the predictive state variable Zv (t+Δt).

Particularly preferred, the piston compressor according to the invention comprising the controllable magnetic bearing is used in combination with a transport ship used for transports over the sea.

Figure 4:
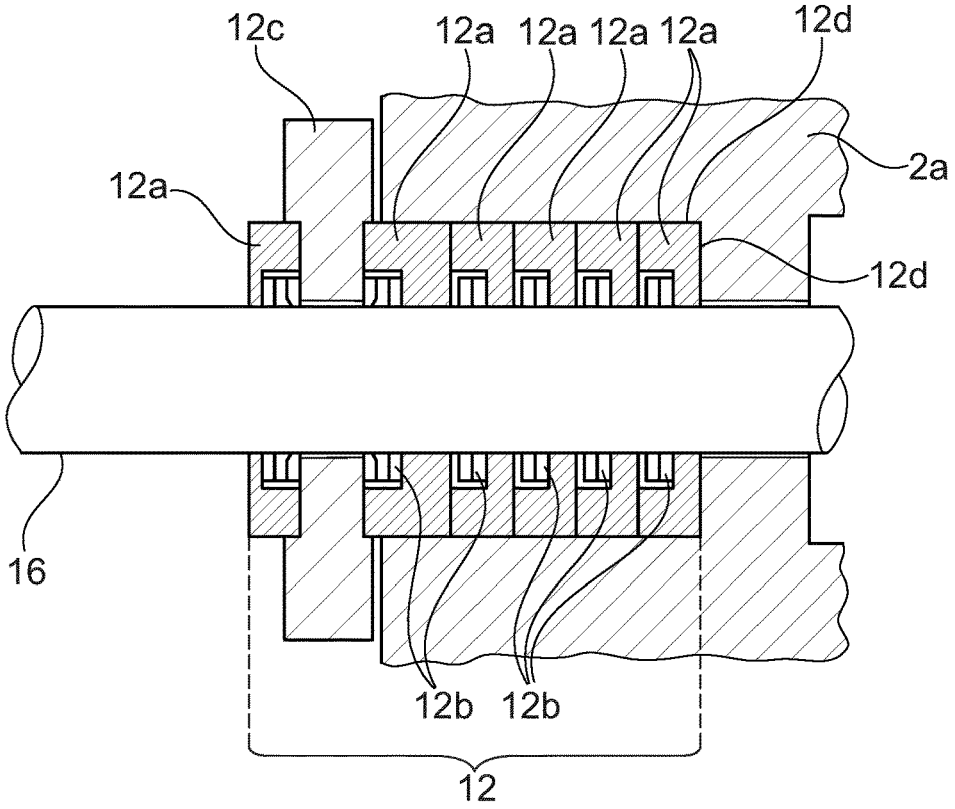
FIG. 4 a longitudinal section through a known packing seal.

The longitudinal section shown in FIG. 4 shows a packing seal 12 known per se, comprising a plurality of chamber rings 12*a* in which sealing rings 12*b* are arranged. In addition, the packing seal 12 comprises a fastening part 12*c*, to which all chamber rings 12*a* are fastened in a manner not shown in detail. The packing seal 12 is connected to a cylinder housing 2*a* of a cylinder 2 via the fastening part 12*c*, wherein a piston rod 16 extends through the packing seal 12. The cylinder housing 2*a* has a recess which corresponds to an outer contour 12*d* of the packing seal 12, so that the entire packing seal 12 can be inserted into this recess and, if necessary, the entire packing seal 12 can be replaced.

Figure 5:
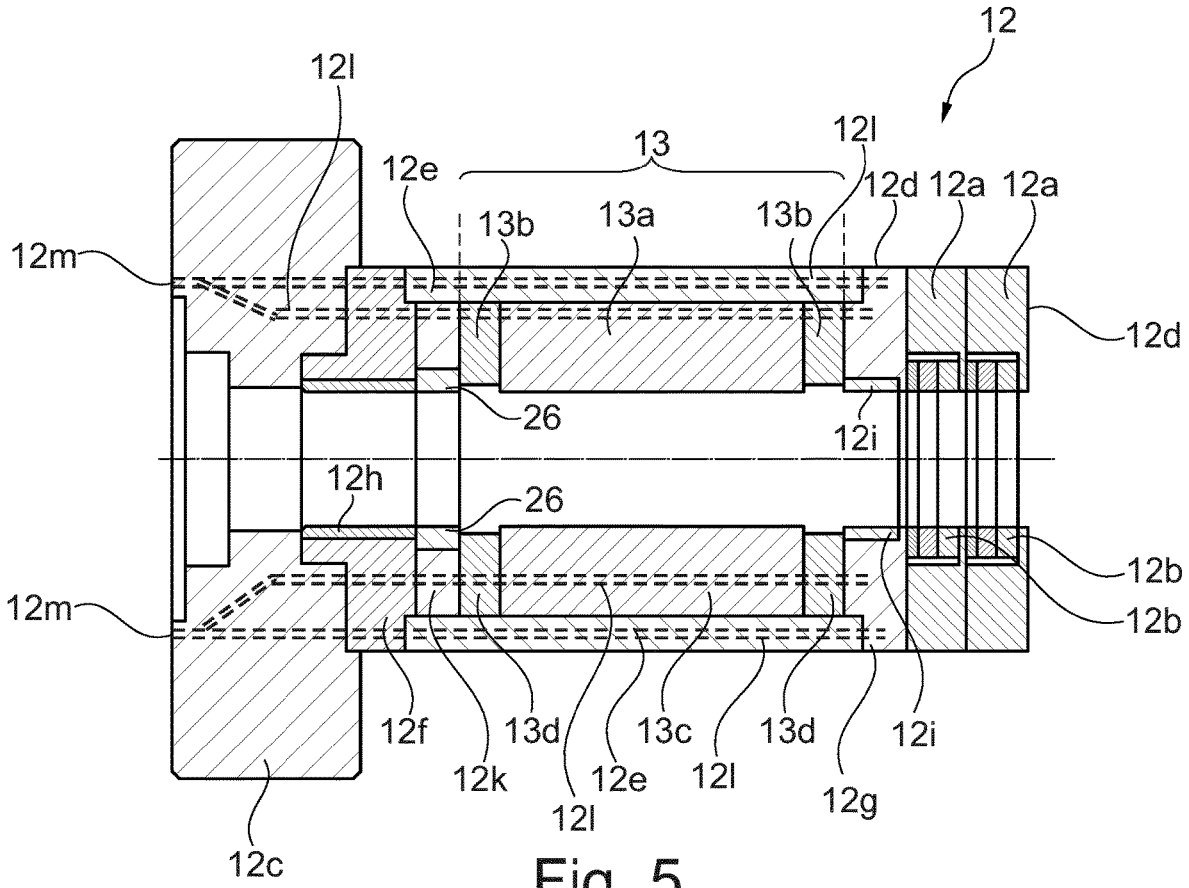
FIG. 5 a longitudinal section through a packing seal according to the invention.

FIG. 5 shows a longitudinal section through a packing seal 12 according to the invention comprising a magnetic bearing 13. FIG. 6 shows a partial section of the magnetic bearing 13, which is designed as a radial bearing and comprises eight coil cores 13*a*, 13*c*, the two opposing coil cores 13*a*, 13*c* being provided with reference signs. The coil cores 13*a*, 13*c* are wound with coils 13*b*, 13*d*. In addition, the end face 13*e* of the coil core 13*a* facing the piston rod 16 is shown. The packing seal 12 according to FIG. 5 comprises two chamber rings 12*a* in which sealing rings 12*b* are arranged. The packing seal 12 also includes two emergency bearings 12*f*, 12*g* each having a bearing surface 12*h*, 12*i*. In the event of a power failure of the magnetic bearing 13 or, for example, when the piston compressor is switched off, the piston rod 16 can rest on the emergency bearings 12*f*, 12*g*. The packing seal 12 further comprises a holder 12*k* for a sensor 26, wherein at least one sensor 26 is arranged at the top, and wherein preferably a plurality of sensors 26 are arranged mutually spaced in the circumferential direction. In addition, the packing seal 12 comprises a fastening part 12*c*, to which preferably all components shown in FIG. 5 are connected. The packing seal 12 has an outer contour 12*d*. In a preferred embodiment, the outer contour 12*d* of the packing seal 12 according to the invention is similarly or identically dimensioned to the known packing seal 12 shown in FIG. 4, so that the packing seal 12 according to the invention can be used in existing piston compressors 1 having the known packing seal 12. Preferably, a piston compressor 1 upgraded with the packing seal 12 according to the invention is also provided with a control device 22, so that existing piston compressors 1 can also be provided with the device according to the invention or existing piston compressors 1 can be operated with the process according to the invention.

In a further, preferred embodiment, the packing seal 12 according to the invention, as shown in FIG. 5, also comprises cooling channels 121, which run, for example, inside the outer casing 12*e* and/or inside the coil cores 13*a*, 13*c*, the cooling channels forming part of a cooling circuit in order to cool the magnetic bearing 13 and/or the packing seal 12. The cooling circuit is shown only schematically, the supply lines and the discharge lines of the cooling circuit preferably running through the mounting part 12*c* in such a way that the mounting part 12*c* has connections 12*m* for the cooling circuit which are accessible from the outside, preferably on its end face, and in that the cooling circuit inside the packing seal 12 is predefined and fully configured, so that after installation of the packing seal 12 only the external coolant supply from the outside needs to be connected to the fastening part 12*c* in order to supply the cooling circuit inside the packing seal 12 with coolant. In FIG. 5, in particular, the connecting channels arranged inside the emergency bearing 12*g* and mutually connecting the cooling channels 121 in a fluid-conducting manner are not shown.

In the embodiment shown in FIG. 1, a piston compressor 1 comprising a piston 3 with piston rings or sealing rings 4 and a guide ring 5 is shown. The guide ring 5 could be dispensed with. In another embodiment, not shown, the piston 3 could also be designed as a labyrinth piston, wherein this labyrinth piston preferably does not touch the inner wall of the cylinder 2.

The invention claimed is:

1. A piston compressor for compressing a gas, comprising a cylinder, a piston, a piston rod, a packing seal, a crosshead, a magnetic bearing, and a drive, wherein the piston is arranged movably in a longitudinal direction L within the cylinder, wherein the piston is connected to the crosshead via the piston rod, wherein there is arranged, between the piston and the crosshead, the packing seal through which the piston rod extends, wherein the crosshead is driven by the drive, the magnetic bearing being arranged between the piston and the crosshead, the magnetic bearing being capable of exerting a magnetic force $F_m$ on the piston rod at least perpendicularly to the longitudinal direction L, and wherein the piston comprises a plurality of sealing rings, wherein a sensor is arranged for detecting a state variable Z of the piston compressor, the magnetic bearing is designed as a controllable magnetic bearing, and a control device controls the magnetic force $F_m$ exerted by the magnetic bearing on the piston rod as a function of the state variable Z, and wherein the sensor is designed to detect the state variable Z that is a variable selected from the group consisting of a displacement path of the piston in the cylinder, a displacement path of the piston rod in the direction of extension of the piston rod, a displacement path of the piston rod perpendicular to the direction of extension of the piston rod, a movement of the piston perpendicular to the direction of extension of the piston rod, an angle of rotation of the drive shaft, a movement of the piston rod perpendicular to the longitudinal direction L, a gap width within the magnetic bearing between the piston rod and a magnet of the magnetic bearing, a mutual position of the piston rod and the magnetic bearing, perpendicular to the longitudinal direction L of the piston rod, an angle of inclination β of the cylinder with respect to a vertical direction V, an angle of inclination (t) assumed between the vertical direction V and the longitudinal direction L in which the piston is moved back and forth as a function of time t, a gap width between the inner surface of the cylinder and the side surface of the piston, and a location of a mutual point of contact between the piston and the cylinder, wherein the packing seal is removable from the piston compressor and comprises, arranged successively in the longitudinal direction L, a fastening part, a holder with the sensor arranged at its top, the magnetic bearing, and a chamber ring with a sealing ring arranged therein, and at least two emergency bearings which are arranged mutually spaced in the longitudinal direction L.

2. The piston compressor according to claim 1, wherein the piston comprises a guide ring.

3. The piston compressor according to claim 1, wherein the cylinder extends in a substantially horizontal direction.

4. The piston compressor according to claim 1, wherein the cylinder extends in a substantially vertical direction.

5. The piston compressor according to claim 1, wherein the sensor is furthermore configured to detect a parameter selected from the group consisting of an angle of inclination (B) of the longitudinal direction L with respect to a vertical direction (V), a gap width between the inner surface of the cylinder and the side surface of the piston, and a location of a mutual contact point of the piston and the cylinder.

6. The piston compressor according to claim 1, wherein the packing seal is configured as a replacement part, and the packing seal comprises both a sealing ring and the magnetic bearing.

7. The piston compressor according to claim 1 wherein the packing seal and the magnetic bearing comprise cooling channels for a cooling medium.

8. A method for operating the piston compressor according to claim 1, comprising the steps of: moving back and forth the piston in the longitudinal direction L within the cylinder, the piston being driven via the crosshead and the piston rod, and exerting the magnetic force Fm acting at least perpendicularly to the longitudinal direction L by the magnetic bearing on the piston rod, and the magnetic force Fm is controlled depending on the state variable Z, and a relief force Fh is thereby exerted on the piston via the piston rod.

9. The method according to claim 8, wherein the longitudinal direction L is substantially in a horizontal direction.

10. The method according to claim 8, wherein the longitudinal direction L is substantially in a vertical direction.

11. The method according to claim 8, wherein the longitudinal direction L has an angle of inclination β in the range of +/−10° with respect to a vertical direction V.

12. The method according to claim 8, wherein a mutual distance between piston rod and magnetic bearing and/or a distance between cylinder inner surface and piston side surface, perpendicular to the longitudinal direction L, is kept constant.

13. The method according to claim 8, wherein the piston is held in the cylinder without contacting a wall of the cylinder.

14. The method according to claim 8, wherein the magnetic force $F_m$ is fixedly predetermined as a function of the state variable Z.

* * * * *